US005482398A

United States Patent [19]

Finke

[11] Patent Number: 5,482,398

[45] Date of Patent: Jan. 9, 1996

[54] COLLAPSIBLE SAFETY SIGNAL AND TRAFFIC BARRICADE

[76] Inventor: Gerald E. Finke, 413 NE. Cambridge Dr., Lee's Summit, Mo. 64086

[21] Appl. No.: 393,068

[22] Filed: Feb. 23, 1995

[51] Int. Cl.[6] ..... E01F 13/00

[52] U.S. Cl. ..... 404/6; 116/63 P; 116/63 R; 256/13.1

[58] Field of Search ..... 404/6, 9; 52/2.18, 52/2.24, 2.25; 256/1, 13.1, DIG. 2; 40/610, 612; 116/63 P, 63 R

[56] References Cited

U.S. PATENT DOCUMENTS

| | | | |
|---|---|---|---|
| 1,263,717 | 4/1918 | Stone . | |
| 3,124,387 | 3/1964 | Maclaren . | |
| 3,136,272 | 6/1964 | Sprigman . | |
| 3,838,883 | 10/1974 | Machen | 297/45 |
| 3,905,324 | 9/1975 | English | 294/1 R |
| 4,183,317 | 1/1980 | Follick | 116/63 P |
| 4,671,566 | 6/1987 | Knapp et al. | 297/16 |
| 4,685,725 | 8/1987 | Helfrich | 297/45 |
| 4,717,201 | 1/1988 | Barras | 297/16 |
| 4,759,606 | 7/1988 | McDowell | 350/97 |
| 4,807,930 | 2/1989 | Helfrich | 297/219 |
| 4,852,511 | 8/1989 | Look et al. | 116/63 P |
| 5,320,404 | 6/1994 | Le Gal | 297/16.2 |

OTHER PUBLICATIONS

*Preferred Living*, Sportsman's Market, Inc., p. 71, 1994.

*Primary Examiner*—Ramon S. Britts
*Assistant Examiner*—Pamela A. O'Connor
*Attorney, Agent, or Firm*—Kokjer, Kircher, Bowman & Johnson

[57] ABSTRACT

A portable and collapsible safety reflector and barricade for use adjacent a stranded vehicle. The barricade includes multiple sets of "x" linkages, each formed of two bars hinged together in the middle for free pivoting. Each corner of each set of linkages is pivotally connected to separate corner links, with each corner link being common between two of the sets. As such, the "x" linkages for a three dimensional structure with corner links at each of the corners of this structure. Two sets of these corner links also mount support staffs, each fixed to a lower one of the associated set of corner links, and mounted for sliding movement with respect to an upper one of the associated set of corner links. The support staffs each mount an end of a band of flexible reflective material. The free ends of the staffs also include mounting cups to receive a light, flare, flag, or other safety signal.

16 Claims, 1 Drawing Sheet

COLLAPSIBLE SAFETY SIGNAL AND TRAFFIC BARRICADE

BACKGROUND OF THE INVENTION

1. Field of the Invention

The present invention relates in general to traffic barricades and signal devices. In particular, the present invention relates to an improved barricade which is lightweight, collapsible, and which may mount a safety light or flare.

2. Description of the Related Art

It has long been known to provide safety devices for use in marking a vehicle location in the event a motorist is stranded. One of the most common examples is the standard road flare, having a spike at one end for insertion into the ground beside the vehicle, and a flammable upper end. As the use of reflective materials has spread, it has also become common to provide small stands with such reflective material, so that the stands may be placed near the vehicle. An example of this is shown in U.S. Pat. No. 4,759,606 to McDowell.

One problem with such devices has typically been their relatively small size. As should be apparent, increasing the size of such devices increases their visibility, and thus the safety provided to the user. There have of course been relatively large traffic barricades known in the art, such as used in road construction and repair. Such devices typically include a large, rigid, reflective panel, and attachments for lights or flags, which make them quite visible. However, these devices are too large to easily store within the trunk of a passenger vehicle. Various collapsible designs of such barricades have been proposed, as shown in U.S. Pat. No. 4,852,511 to Look et al. and U.S. Pat. No. 4,183,317 to Follick. Even these collapsible designs have been too large, however, for storage in a standard passenger vehicle.

SUMMARY OF THE INVENTION

An object of the present invention is to provide a safety reflector and barricade which is easily visible and which provides great safety for a stranded vehicle, or other hazard.

Another object of the present invention is to provide such a reflector and barricade which provides a large reflector panel and attachment points for lights, flares, flags, etc.

Another object of the present invention is to provide a safety reflector and barricade which is collapsible for easy storage.

Yet another object of the present invention is to provide such a collapsible barricade which collapses to a sufficiently small size that it may be easily stored in the trunk of a passenger vehicle.

A further object of the present invention is to provide such a collapsible barricade which is simple to convert from the collapsed to the operative condition.

Yet another object of the present invention is to provide such a collapsible barricade in which the large reflector panel is formed of flexible material so that it too may be placed in a storage condition of reduced size.

These and other objects are achieved by a portable and collapsible safety reflector and barricade for use adjacent a stranded vehicle, road hazard, etc. The barricade includes multiple sets of "x" linkages, each formed of two bars hinged together in the middle for free pivoting. Each corner of each set of linkages (i.e., each end of each bar) is pivotally connected to separate corner links, with each corner link being common between two of the sets. As such, the "x" linkages for a three dimensional structure with corner links at each of the corners of this structure. Two sets of these corner links also mount support staffs. The support staffs are elongated members, each fixed to a lower one of the associated set of corner links, and mounted for sliding movement with respect to an upper one of the associated set of corner links. The support staffs extend upward beyond the corner links, and in this extending section each mount an end of a band of flexible material. The flexible material includes reflective markings. The free ends of the staffs also include mounting cups to receive a light, flare, flag, or other safety signal. The linkages may be placed in a storage condition in which the linkages are pivoted such that the bars are approaching parallel and the staffs are draw closely together. In this storage condition the barricade has a relatively small width of peripheral length, and may be easily stored. The flexible material does not inhibit movement to this storage condition. Manually pushing the corner links downward will cause the "x" linkages to move to a near perpendicular condition, greatly increasing the width or peripheral length of the barricade, and drawing the fabric band taut. In this operative condition the barricade will stand in a stable manner.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
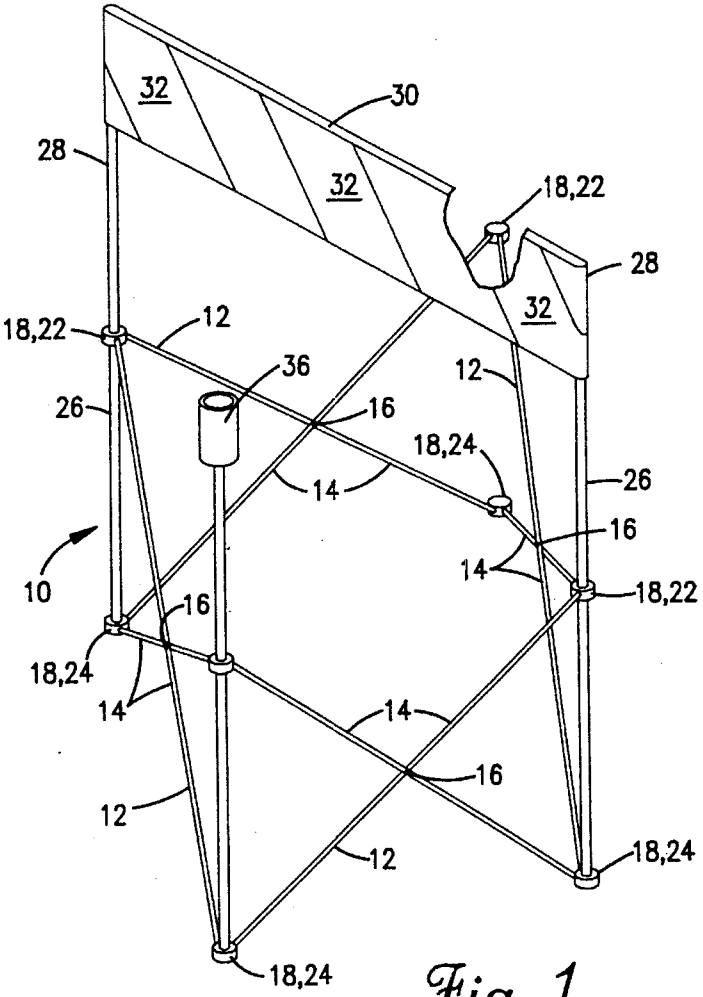
FIG. 1 is a perspective view of the barricade according to the present invention in the operative condition.

With reference to FIG. 1, a barricade according to the present invention is designated generally by reference numeral 10. The barricade 10 is intended for use by stranded motorists. in particular, the barricade 10 will be stored within the trunk (or other suitable area) of a vehicle. If the vehicle is stranded due to malfunction, or other emergency situation occurs, the barricade is erected adjacent the stranded vehicle or other road hazard to warn approaching vehicles if its presence.

The barricade 10 includes multiple sets of "x" linkages 12. Each set of "x" linkages is formed by two substantially rigid, elongated rods 14. The rods 14 may be formed of a lightweight metal such has aluminum, by plastic, or by other appropriate materials. Each of the rods 14 has a substantially equal length, and the two rods of each set are pivoted together at substantially the mid-point of each rod. This pivoting may be effected by forming a hole through each rod and them placing a bolt 16 therethrough, or by other appropriate means.

As may be envisioned, for each set of pivoted rods, the rods may take various relative angular configurations. Specifically, the rods could be pivoted until they are parallel, or perpendicular. Once formed together into the barricade 10, however, this range of angular motion is restricted.

Figure 3:
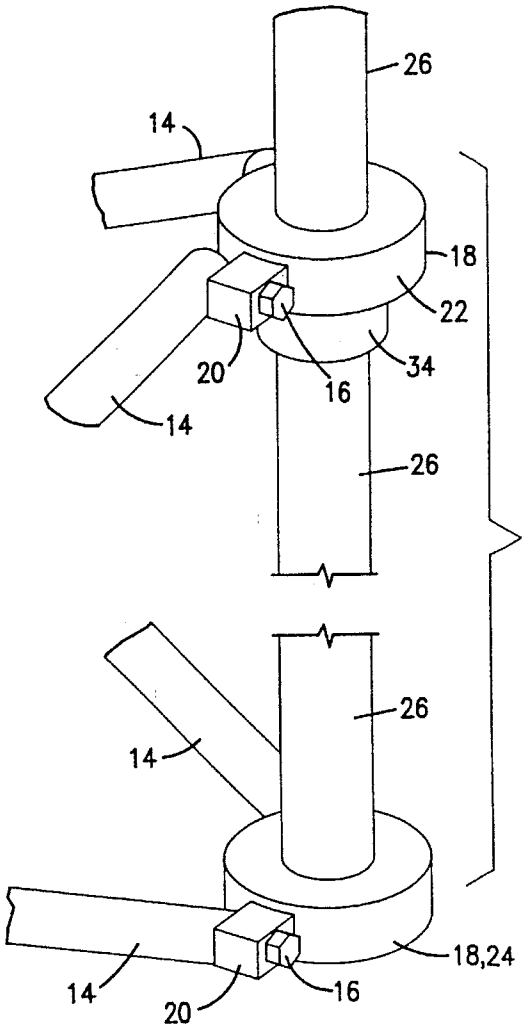
FIG. 3 is a detail perspective view showing the connections to the corner links.

Each end of each rod 14 is pivotally connected to a corner link 18. As is best shown in FIG. 3, the corner links are preferably generally planar elements oriented to be generally parallel to the ground. The outer periphery of the corner links may be circular, square, triangular, etc. The outer portions of the corner links do, however, include a lug 20 or other appropriate means for pivotally connecting to the end of the rod 14. As with the center pivot, this connection may be formed by a bolt 16 extending through the rod and lug, or by other appropriate means. A preferred corner link may be obtained via EZ Seat, Inc. of Kingsport, Tenn.

Furthermore, each corner link will be so pivotally connected to two separate rods, with each of the rods being from different "x" linkages 12. This is best shown in FIG. 1, where each of the corner links forms a corner of the three dimensional structure of the barricade. Due to this connection, each "x" linkage 12 will form a vertical wall of the barricade, with each such wall having the pivot point between the rods at its center, and one of the corner links 18 at each of its four corners. This positioning of the corner links 18 thus lends a further distinction, where half of the corner links 18 are upper links 22 and the remaining half of the corner links are lower links 24.

It is noted that in the embodiment shown there are four sets of "x" linkages, and thus for walls to form a square structure (when viewed from above). Other arrangements such a three, five or more walls may also be employed. As a general principle, there will be n sets of "x" linkages with n being greater than two. To connect these "x" linkages, there will be employed **2*n*** corner links.

As may be envisioned, the pivotal connections between the rods and corner links will render the structure unstable. To provide stability and visibility, there are provided two staffs 26. Each of the staffs is associated with a set of upper and lower corner links, such that the staffs extend vertically. As is best shown in FIG. 3, the lower end of each staff is fixed to the associated lower corner link 24. In contrast, the staff is mounted for sliding with respect to the associated upper corner link 22. This sliding mount may most easily be effected by forming a vertical hole through the corner link and passing the staff therethrough.

It is preferred that the staffs be mounted to upper corner links which are not adjacent, such as is shown in FIG. 1. This arrangement results in the band 30 having a greater length, and thus greater visibility.

Each staff is a substantially rigid elongated member, having a length greater than that of the rods 14. As such, the upper end 28 of the staffs 26 will extend above the upper corner links 22. To these upper ends are mounted the ends of a band 30 of flexible material, such as nylon, polyethylene, cotton, etc. This mounting may be effected by passing the ends of the band about the staffs and securing the ends to the band, or by other suitable means. The looped section may then be fixed to the staff by adhesive or heat bonding, or by other arrangements. The band 30 will at least include areas 32 of high reflectivity, such as by application of a reflective coating, tape, etc. While the entire band may be reflective, it is preferred that the areas 32 form a diagonal stripe pattern such as is commonly employed for construction barricades. Between these stripes it is preferred that the material be brightly colored, such as with orange or red, to increase daytime visibility. Such brightly colored areas may of course also be highly reflective, but of a contrasting color to the stripes. Alteratively, or additionally, other reflective patterns or indicia, including words such or "WARNING" or "KEEP OUT" may be used on the band.

As may be envisioned, the band of material will place a limit upon the motion of the staffs, such that they may move laterally apart only until the band 30 is taut. This restriction in the motion of the staffs will in turn cause the corner links and rods 14 to be restricted in their movement and thus provide a stable structure as shown in FIG. 1. This is the operative condition of the barricade 10. In this condition the rods 14 are approaching a perpendicular orientation, and the corner links are widely spaced.

To reduce the tension on the band 30, there may additionally be provided stop bands 34 (FIG. 3), such as a rubber or metal ring, fixed to the staffs to limit downward movement of the upper corner links along the staffs. These stop bands will also restrict movement as with the band 30.

Figure 2:
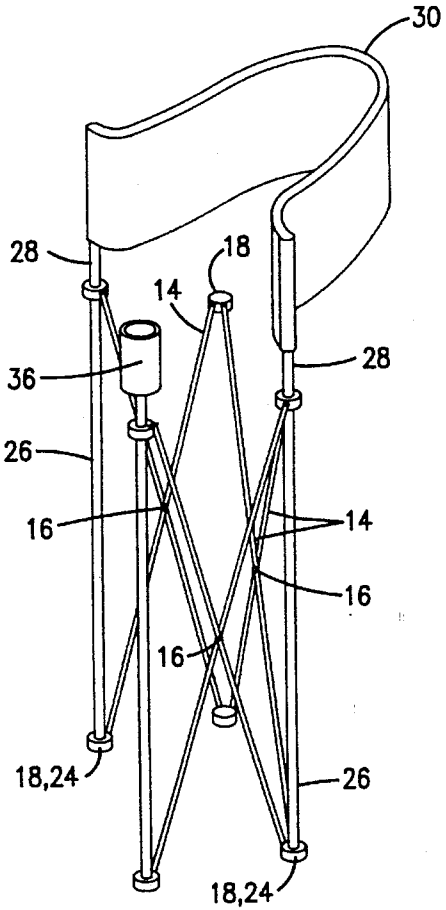
FIG. 2 is a perspective view of the barricade of FIG. 1 in the storage condition.

While the band 30 prevents outward movement of the staffs and downward movement of the upper corner links when it is taut, the flexible nature of the band 30 does not prevent inward movement of the staffs from the operative position of FIG. 1. As such, the user may manually push the staffs laterally inward, causing the rods to pivot toward a nearly parallel orientation, and causing the corner links to be closely spaced. During this movement the flexible band 30 merely flexes and does not impeded this movement. Movement will finally be stopped due to interference between the rods and links. At this position the barricade 10 is in the storage condition, as shown in FIG. 2.

As may be seen, the barricade 10 may thus quickly and easily move from the operative to the storage condition, and vice versa. In the storage condition the barricade is sufficiently small to easily be stored in a vehicle trunk, and is quite lightweight. In the operative condition the barricade provides a large area of reflectivity, increasing the possibility that the barricade will be seen.

To increase the possibility of the barricade being seen, the barricade may be provided with one or more secondary staffs 36. These secondary staffs are essentially identical to the staffs 26, and are connected to the corner links in the same way, but have at their upper ends an upwardly opening mounting cup 36. The mounting cups are sized such that they may receive the spiked end of a standard flare, such that the flare may be mounted at the upper end of the barricade. Additionally, the handle end of a flashlight, or the handle of a flag could also be mounted in the cups 36. As such, the cups 36 permit the barricade 10 to be used with additional safety items to increase the visibility of the barricade further. As an alternative to rigid cups, there may be provided a semi-flexible coil which will frictionally retain the above-noted items. Alternatively, the upper end of the staff may simply have a hole therein to receive the spike of the standard flare. Such cups, coils and holes are generally referenced as means for mounting an item from the group of flares and electric lights.

As a final option, there may be provided a strip of material (not shown) having hook and loop fastener segments at the ends, such that this strip of material may be placed about the barricade in the storage condition to maintain it in this condition. This strip may be easily removed to place the barricade in the operative condition.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A portable, collapsible safety barricade, comprising:

n sets of "x" linkages, where n is an integer greater than two, each set of linkages comprising two rods of substantially equal length pivoted together at substantially the mid-point of said rods;

2*n* corner links, one of said corner links being pivotally connected to each end of each of said rods, with each said corner link being pivotally connected to two of said rods from different ones of said sets of linkages, thereby defining n sets of associated upper and lower sets of associated corner links;

a pair of staffs, each staff being elongated with a length greater than that of said rods, each said staff being associated with an individual set of said upper and lower corner links, each said staff having a lower end fixed to said associated lower corner link, and mounted for relative sliding with said associated upper corner link;

a band of flexible material extending between and mounted to upper ends of said staffs, said flexible material at least having areas of high reflectivity;

said barricade being movable between a storage condition in which said rods approach a parallel orientation and an operative condition in which said rods approach a perpendicular orientation and said band is taut.

2. A barricade as in claim 1, wherein said areas of reflectivity includes diagonal stripes of said high reflectivity, and further having between said stripes a contrasting color readily visible in daylight.

3. A barricade as in claim 1, wherein n is four, and further wherein said sets of corner links associated with said staffs are not adjacent.

4. A barricade as in claim 3, wherein said areas of reflectivity includes diagonal stripes of said high reflectivity, and further having between said stripes a contrasting color readily visible in daylight.

5. A barricade as in claim 1, wherein said barricade, in said storage condition, is sized to be easily placed in, and removed from, a trunk of a passenger automobile.

6. A barricade as in claim 5, wherein said areas of reflectivity includes diagonal stripes of said high reflectivity, and further having between said stripes a contrasting color readily visible in daylight.

7. A barricade as in claim 5, wherein n is four, and further wherein said sets of corner links associated with said staffs are not adjacent.

8. A barricade as in claim 7, wherein said areas of reflectivity includes diagonal stripes of said high reflectivity, and further having between said stripes a contrasting color readily visible in daylight.

9. A barricade as in claim 1, further comprising at least one secondary staff, each secondary staff being elongated with a length greater than that of said rods, each said secondary staff being associated with an individual set of said upper and lower corner links, each said secondary staff having a lower end fixed to said associated lower corner link, and mounted for relative sliding with said associated upper corner link, each said secondary staff including at its upper end means for mounting an item from the group consisting of flares and electric lights.

10. A barricade as in claim 9, wherein said areas of reflectivity includes diagonal stripes of said high reflectivity, and further having between said stripes a contrasting color readily visible in daylight.

11. A barricade as in claim 9, wherein n is four, and further wherein said sets of corner links associated with said staffs mounting said band are not adjacent.

12. A barricade as in claim 11, wherein said areas of reflectivity includes diagonal stripes of said high reflectivity, and further having between said stripes a contrasting color readily visible in daylight.

13. A barricade as in claim 9, wherein said barricade, in said storage condition, is sized to be easily placed in, and removed from, a trunk of a passenger automobile.

14. A barricade as in claim 13, wherein said areas of reflectivity includes diagonal stripes of said high reflectivity, and further having between said stripes a contrasting color readily visible in daylight.

15. A barricade as in claim 13, wherein n is four, and further wherein said sets of corner links associated with said staffs are not adjacent.

16. A barricade as in claim 15, wherein said areas of reflectivity includes diagonal stripes of said high reflectivity, and further having between said stripes a contrasting color readily visible in daylight.

* * * * *